United States Patent [19]

Kruchen

[11] 4,169,706

[45] Oct. 2, 1979

[54] METHOD OF CLEANING POULTRY FEATHERS

[76] Inventor: Ernst Kruchen, Bahnhofstrasse 48, 4404 Telgte, Fed. Rep. of Germany

[21] Appl. No.: 852,301

[22] Filed: Nov. 17, 1977

Related U.S. Application Data

[63] Continuation of Ser. No. 695,474, Jun. 14, 1976, abandoned.

[30] Foreign Application Priority Data

Jul. 18, 1975 [DE] Fed. Rep. of Germany ..... 2532158
Mar. 25, 1976 [DE] Fed. Rep. of Germany ..... 2612589

[51] Int. Cl.[2] ..... D06M 19/00; D06B 9/06

[52] U.S. Cl. ..... 8/94.1 R; 8/139.1; 8/142

[58] Field of Search ..... 134/12, 25 R, 26, 40; 8/10, 94.1 R, 139.1, 142, 150; 34/2; 427/323; 68/210

[56] References Cited

U.S. PATENT DOCUMENTS

| | | | |
|---|---|---|---|
| 81,709 | 9/1868 | Viol et al. | 8/10 |
| 1,596,100 | 8/1926 | Hiltner | 8/139.1 |
| 2,501,184 | 3/1950 | Michaels et al. | 8/10 |
| 2,714,767 | 8/1955 | Frederick et al. | 34/2 |
| 2,805,914 | 9/1957 | Frederick et al. | 8/94.1 R |
| 2,821,456 | 1/1958 | Frederick | 8/94.1 R X |
| 3,384,445 | 5/1968 | Gilbert | 8/139.1 X |
| 3,475,112 | 10/1969 | Mahall | 34/2 X |
| 3,854,871 | 12/1974 | Eanzel | 8/142 |
| 3,859,223 | 1/1975 | Castrantas et al. | 8/142 X |

FOREIGN PATENT DOCUMENTS

| | | | |
|---|---|---|---|
| 467594 | 6/1937 | United Kingdom | 68/210 |

*Primary Examiner*—Marc L. Caroff
*Attorney, Agent, or Firm*—Fitch, Even & Tabin

[57] ABSTRACT

A method is disclosed for cleaning poultry feathers without the feathers becoming substantially twisted or clotted in lumps and with the feathers retaining its high bulk and tufted state. The method includes a washing of the feathers in a washing chamber with an organic cleaning liquid consisting primarily of chlorinated hydrocarbons, drying the feather material in a drying compartment at a temperature of up to 130° C. with the volume of the drying compartment exceeding that of the washing chamber by from three to ten times and distilling the cleaning liquid to remove solid materials therefrom to prepare the cleaning liquid for reuse in the washing step.

4 Claims, 1 Drawing Figure

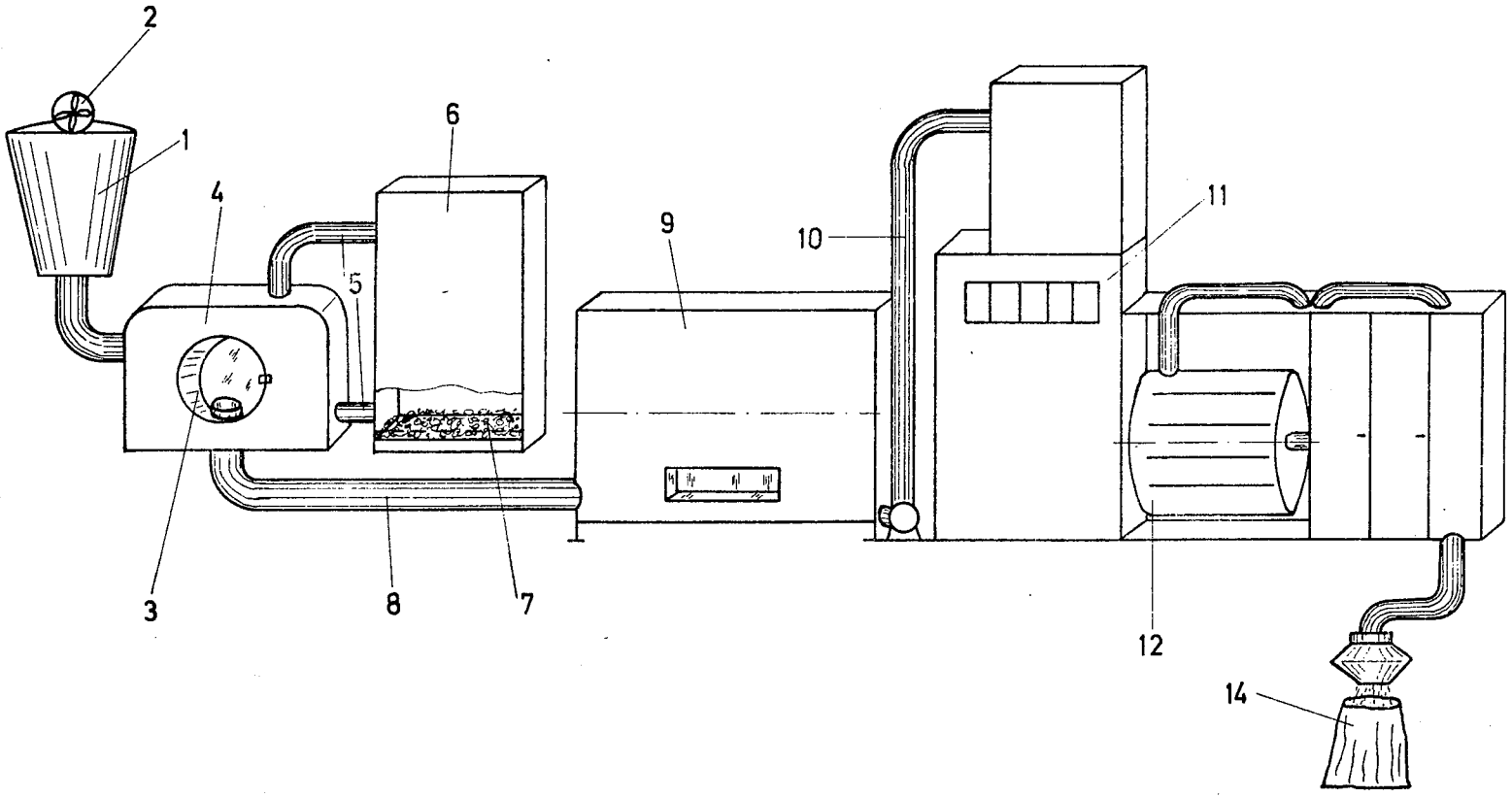
1
2
3
4
5
6
7
8
9
10
11
12
14

METHOD OF CLEANING POULTRY FEATHERS

This is a continuation of application Ser. No. 695,474, filed June 14, 1976, now abandoned.

The present invention relates to a method of cleaning poultry feather wherein the feather material is washed with defatting and dirt dissolving and dispersing liquid media and subsequently dried.

It is known to treat poultry feather material, particularly bed feather material or downs, conventionally in such a way that a washing liquid consisting of water with soap or detergents is provided, in which liquid the feather material is moved to and fro by means of beaters until the cleaning process is completed. Thereafter, the feather material is dried, generally at a temperature of from 80° to 120° C. In the conventional cleaning method, the water, optionally in a pre-clarified condition, is discharged into the drainage system. One kilogram of feather to be cleaned requires from about 200 to 300 kg of washing water. As the washing water is frequently contaminated to a substantial degree, especially by repugnant substances, preclarification of the cleaning liquid in many cases requires substantial investigations to be made. Further, it has been found that poultry feather material, particularly if obtained from animals which have been bred in intensive breeding farms, are greatly mudded by droppings so as to be very difficult to clean.

Accordingly, it is the object of the present invention to improve the conventional washing method in the following respects:

The costs, in particular those resulting from the high demand of water and detergents, should be reduced. The same applies to cost resulting from the provision of clarification or sewage-treatment plants, grease separators and the like; environmental disturbance by the waste water (sewage) is to be avoided; even greatly contaminated feather material should lend itself to be properly cleaned; the feather material should be adapted to be processed or treated in the course of the cleaning process, for instance by means of bleaching agents and/or optical brighteners; the method should comply with every hygienic requirement in a particularly favorable manner.

These and further advantages which become evident from the specification and which are known to the expert are solved by a cleaning method comprising said feather material is washed in washing chambers with an organic cleaning liquid consisting essentially of chlorinated hydrocarbons, and said feather material is thereafter dried in one or more drying compartments at temperatures of up to 130° C. with the volume of said drying compartments exceeding that of said washing chambers by from three to ten times, whereby said cleaning liquid, in a manner known per se, is passed in a closed recirculation system.

The cleaning process is carefully performed at temperature of between 40° and 80° C., preferably at about 60° C. This relatively low temperature at the same time facilitates the drying step.

Actually, it is known to clean and degrease textiles, fur and leather by using especially chlorinated hydrocarbon cleaning liquid. Until the present time, however, such cleaning method has never been taken into consideration, as far as is known, for the cleaning of poultry feather being a highly sensitive material. Prior tests have shown that drying in large volume is of major importance if the bed feathers are to be prevented from becoming "twisted", i.e., distorted in themselves, or from becoming clotted in lumps. Rather, the material must exist in particularly high-bulk and tufty state if it is to meet the consumers' exacting quality requirements.

In particular, it is proposed that in the case of using known per se cleaning machines, e.g. such having a volume (rated capacity) of from 60 to 150 kg of leather or textile material, this capacity is utilized by only about from 5 to 20%; this means that the quantity of the feather material to be cleaned amounts to only about 10 kg in the case of a rated capacity of 100 kg as regards the capacity for textile materials.

As a special feature, it is proposed that $C_2$ hydrocarbon derivatives are used as the cleaning liquid. These derivatives include trichloroethylene, perchloroethylene, tetrachloroethylene, tetrachloroethene and mixtures thereof. Liquids of this type are customary for dry cleaning purposes, and they are available in great quantities and at low cost. Their technology can be fully controlled in cleaning machines operating with closed-loop recirculation systems.

In order to render possible the use of water-soluble finishing materials, and in order to improve the cleaning process, a quantity of from 5 to 20% and preferably 10% of water may be added to the cleaning liquid for the cleaning process.

Depending on the specific requirements, the feather material may be treated until a predetermined degree of degreasing is obtained. However, it is further proposed to re-grease the feather material after the washing and/or drying steps if, for instance, specific synthetic grease or fats are desirable.

Also, the cleaning liquid may be admixed with bleaching agents and/or optical brighteners, such that it becomes possible to bleach or brighten even originally darker or more pigmented feathers.

Furthermore, it should be possible to improve the properties of the feather material, particularly to provide such material with a finish or coloring, i.e., to process the feather material in a manner similar to textile fibers. Moreover, it should be possible to obtain specific electrostatic states. Therefore, it is another object of the present invention to provide the facilities for the dyeing, the application of finishing agents and the provision of an electrostatic state.

Additionally, in order to improve the resilience ("springiness") and the useful life of the feather material, not only a controlled degreasing, but also a regreasing should be feasible. Also, it should hereby be possible to fully or partially coat the feather material with coating plastic materials. It is particularly such treatment that provides durable resilience and an electrostatic charge.

Dyeing of the feather material is advantageous in order to identify various degrees of quality or to give the feather material a uniformly white coloring. White coloring is obtained by adding a specific blue shade or pigment, and such coloring is of interest because, for historical reasons, the maximum quality is principally attributed to feathers or downs of completely white color.

By impregnation or finishing of the feather material it may be obtained that such material becomes fully suitable to be washed, so as to provide hygienically improved usefulness even for the normal consumer. At the same time, the impregnation improves, or even furnishes, the durability and the resilience, such as in the case of chicken feathers.

Still further, the useable finishing agent may serve to broaden the range of usefulness of the feather material, particularly if the individual feathers can be completely coated with a plastic material. Then, such feather material can be used for novel industrial applications, too.

The abovementioned objects are solved in accordance with the invention in that in the above-discussed method of cleaning poultry feather, the cleaing liquid has added thereto finishing agents and/or dyes.

Normally, in the conventional method using water and washing-active substances dissolved therein, the feather material is dusted off prior to the washing step as such. The dust removal is hygienically harmful in so far as the feather material is not subjected to disinfection and dry excrement and protein particles may possibly become suspended in the atmosphere such that infections cannot be disregarded. In the conventional method, however, a preceding dust removal step has been found to be necessary as the washing-active liquid is overloaded or not economically utilized, respectively.

On the other hand, it is of advantage in the novel method that increased capacity of absorption for contaminants is provided by the cleaning liquid being passed in a recirculation system, such that dust removal, i.e., making the feather material free of any loose particles adhering thereto, may be effected after the drying operation. Only aseptic dust is produced during such dust removal from the already washed feather material, such that no injury to health can be caused.

Further, it is of advantage in the novel method that animal fats or greases and/or solvents may be recovered from the distillation bottoms in the solvent recirculation system. Particularly the animal fats or greases as separated from the feather material represent valuable starting products for the cosmetics industries. The cost of the method can be further reduced by selling the distillation bottoms.

The method according to the present invention is explained in exemplary way by means of the attached drawing. The FIGURE of such drawing shows in schematical view a cleaning machine including a solvent recirculation system as well as drying and dust removing apparatuses.

The raw feather material is first stored in a reservoir 1. By means of a blower 2, this feather material is fed directly into the washing chamber 3 of a drum-type washing machine 4. The drum-type washing machine contains an organic solvent, for instance a mixture of perchloroethylene and trichloroethene. Hereby, the capacity of the washing chamber 3 is utilized by only 10% of the normal rated capacity for the cleaning of textiles. After a washing period of from 10 to 20 minutes, the washing operation is completed. The washing liquid is separated from the feather material by centrifuging, and passed through the regeneration circuit 5 including a distillation vessel 6. In the distillation vessel 6, distillation bottoms (fractions) 7 accumulate at the base, which bottoms consist mainly of animal fats or greases and/or solvent residues.

The feather material moistened by only a minor quantity of solvent (the feather material is centrifuged until "hand dry") is then blown, again through a suction pipe 8, into a drying apparatus 9. In such drying apparatus, the feather material is freed from the adhering solvent residues by means of hot air at a temperature of from about 80° to 120° C. It is hereby important that the volume of the drying apparatus is equal to about from three to ten times the volume of the washing chamber 3 such that the feathers are allowed to freely move and to retain their tufty consistency. As indicated in the sketch, the feather material may then be discharged from the apparatus 9 via a pipe or conduit 10, whereupon the material is fed into a dust removing apparatus 11 where the feathers are blown through or purged from all sides so as to remove any loose particles. Among other components, the dust removing apparatus comprises screens in front of which the feather material is whirled around and blown through or purged. The dust particles are collected by a filter 12. Then, the feather material is filled into shipping containers 14.

As mentioned in the introductory part, it is possible to re-grease or re-fat the feather material by using dissolved sheep's wool fat (lanoline) in the washing chamber 3 or in the drying compartment, e.g. to spray the feather material with a fat or grease solution after the centrifuging step. Also, it is possible to add to the cleaning liquid bleaching agents (e.g. a 1–2% concentration of hydrogen peroxide $H_2O_2$) and/or optical brighteners and/or antistatic agents (e.g. Reginal manufacturer Ciba-Geigy), whereby the properties of such agents are transmitted to the feather material such that the latter is brightened or imparted a higher degree of optical reflection and the feathers appear to be brighter or more tufty, respectively.

The solvent is substantially not lost during the cleaning operation; rather, the solvent is regenerated, filtered and distilled after each cycle. The machinery required to this end is well known in cleaning industry. The requisite modifications involve particularly the facilities for conveying the feather material by means of a blower pipe which, as customary, facilitates handling of the feather material.

The cleaning operation as such with the addition of finishing and dyeing agents is preferably performed in such a manner that charges (batches) of the cleaning liquid are introduced into the drum-type washing chamber (s) and after the cleaning operation subjected to filtration and distillation for the purification of such cleaning liquid proper, while the respective next charge effects the cleaning of the feather material, and that during the subsequent purification of the liquid of this (next) charge another charge or a previously used, already purified charge is used for cleaning purposes, whereby other or incremented finishing agents, dyeing agents or coating plastics may be supplied with each charge or batch. The same applies also with respect to the addition of fats or greases for the re-greasing of the feather material.

In detail, this can be done, for example, in such a way that the content of a first tank is initially fed into rotating washing drum and retained in the latter for a washing period of from about 5 to 15 minutes, depending on the degree of contamination, the finishing agent added and the like, as well as on the degree of cleaning desired.

Following the partial cleaning and/or finishing steps, an intermediate centrifuging step for separating the feather material from the cleaning liquid and draining of the liquid into an empty tank take place. While the liquid from the tank is now being subjected to distillation and filtration so as to purify this liquid itself, cleaning liquid from a second tank is fed into the cleaning or washing drum, and the cleaning and finishing process is repeated. If required, another charge or batch of the cleaning liquid is supplied after the repeated separation between feather material and cleaning liquid, which liquid either may be supplied from another tank, or consist of the first charge which has meanwhile been purified.

Accordingly, several cleaning steps may be performed with only two feeds of the cleaning liquid, whereby a third tank is filled with a reserve quantity. In other embodiments, however, any desired number of fillings may be used in combination with any desired number of cleaning steps.

Advantageously, the cleaning liquid is heated to e.g. 60° C., and it may have a water content of about 10%. The additives for dyeing (e.g. P-pigments or dyes—manufacturer Pfersee, 89 Augsburg/Germany), finishing and full or partial coating with plastic material may be added in each bath, whereas the fat or grease for the re-greasing of the feather material, of course, can be added to the last bath only. In addition to complete cleaning, it is in this way possible, for the first time and in a manner being surprising to the expert, that a quality of the feather material, as far as the grease content and the useful life are concerned, can be obtained which is equal to that of uncleaned feathers.

By using the cleaning liquid, it is possible to employ all agents as customarily used for textile finishing, also for the finishing of the feather material and to deposit auxiliary agents. To this end, the carrier liquid may have admixed thereto a "reinforcing material" such as is known from the textile finishing. Likewise, coating with plastic materials, e.g. synthetic resins and the like (for example, Braxan SF, manufactured by Ciba-Geigy), may be effected in the drum during the cleaning treatment. Such coating may be effected both to 100% and partially. Particularly the partial coating resulted, in a manner being absolutely surprising to the expert, in a specifically high degree of electrostatic charge of the feather material, which charge is variable and durable or permanent. This electrostatic charge forms a basis for an anti-rheumatic therapeutical effect to the final users of the feather material.

The coating with synthetic resins results particularly in a substantially improved resilience or "springiness", and it serves to substantially improve the insulation and heat-retaining effect of the feathers in addition to improving their useful life.

Summarizing, the subject matter of the present invention provides a not unessential improvement of the method according to the West German patent application No. P25 32 158.8 filed July 18, 1975 in West Germany. The increase of the resilience is of particular importance for the reason that such resilience allows to process even such feather materials which as such do not show any elasticity or a very low degree of elasticity only. Feathers of this kind which, naturally, prevail over feathers showing inherent elasticity, may then be used on large scale for the filling of bed particles. Due to the extremely fine branching of a natural feather bearing a plastic material coating of minimum thickness, there is further provided a plastic body having an extremely great surface area and minimum weight. Such plastic bodies find a number of industrial applications in the filtration and filling field, which applications cannot yet be fully overlooked at the present time.

What is claimed is:

1. A method of cleaning large batches of poultry feather material without the feathers becoming substantially twisted or clotted in lumps and with the feather material retaining its bulk and tufted state, said method comprising the steps of: prior to removing dust from the feathers performing the step of washing the feather material in a washing chamber with an organic cleaning liquid consisting primarily of chlorinated hydrocarbons to provide cleaned feathers and aseptic dust, centrifugally separating said organic cleaning liquid from said feather material, blowing the feathers through a passageway from said washing chamber to a separate drying compartment separated from said washing chamber, drying said feather material in said drying compartment at temperatures of up to 130° C. with the volume of said drying compartment substantially exceeding that of said washing chamber to prevent the feathers from becoming twisted during drying and to provide feathers in a high-bulk and tufted state, blowing the feathers from said drying compartment through a pipe to a separate dust removing apparatus, filtering the aseptic dust in a filter, removing aseptic dust from said cleaned feathers by blowing the feathers in said dust removing apparatus to separate aseptic dust from the feathers, discharging the cleaned and dusted feathers from said separate dust removing apparatus, and processing said centrifugally separated cleaning liquid by a distillation thereof in a distillation vessel separate from said washing chamber to remove solids and other foreign materials to prepare said cleaning liquid for reuse in said washing step, recycling said distilled cleaning liquid to said washing chamber, and recovering animal fats or greases from a distillation bottom fraction obtained by said distillation of said cleaning liquid.

2. A method in accordance with claim 1 including the further step of storing undusted feathers in an enclosed reservoir and blowing the undusted feathers through an enclosed passageway from said reservoir to said washing chamber.

3. A method in accordance with claim 1 in which said feathers are washed for a period of from 10 to 20 minutes before being blown to said drying compartment.

4. A method in accordance with claim 1 in which the feathers are partially washed and cleaned with a first cleaning liquid which is centrifuged and separated from the feathers and a second cleaning liquid is fed into said washing chamber to further wash said feathers while said first cleaning liquid is being processed to purify the same.

* * * * *